US010487431B2

(12) United States Patent
Kim et al.

(10) Patent No.: US 10,487,431 B2
(45) Date of Patent: Nov. 26, 2019

(54) NOISE LEAKAGE PREVENTING APPARATUS AND CLOTHES TREATING APPARATUS HAVING THE SAME

(71) Applicant: LG ELECTRONICS INC., Seoul (KR)

(72) Inventors: Jinwoong Kim, Seoul (KR); Wongi Park, Seoul (KR); Jinyoung Park, Seoul (KR); Sangwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 113 days.

(21) Appl. No.: 15/634,399

(22) Filed: Jun. 27, 2017

(65) Prior Publication Data

US 2018/0010278 A1 Jan. 11, 2018

(30) Foreign Application Priority Data

Jul. 6, 2016 (KR) ..... 10-2016-0085726

(51) Int. Cl.

| | |
|---|---|
| ***D06F 37/22*** | (2006.01) |
| ***D06F 37/04*** | (2006.01) |
| ***D06F 39/04*** | (2006.01) |
| ***D06F 39/08*** | (2006.01) |
| ***D06F 39/10*** | (2006.01) |
| ***D06F 39/12*** | (2006.01) |
| *A47L 15/42* | (2006.01) |

(52) U.S. Cl.

CPC ..... *D06F 37/22* (2013.01); *D06F 37/04* (2013.01); *D06F 39/04* (2013.01); *D06F 39/085* (2013.01); *D06F 39/10* (2013.01); *D06F 39/12* (2013.01); *A47L 15/4209* (2016.11)

(58) Field of Classification Search

CPC ..... D06F 37/22

See application file for complete search history.

(56) References Cited

U.S. PATENT DOCUMENTS

2014/0230497 A1 8/2014 Rockwell et al.

FOREIGN PATENT DOCUMENTS

| | | |
|---|---|---|
| CN | 1882737 | 12/2006 |
| CN | 200971437 | 11/2007 |
| DE | 299 00 575 | 7/1999 |
| EP | 2 815 688 | 12/2014 |
| JP | H01 209098 | 8/1989 |
| WO | WO 98/30831 | 7/1998 |
| WO | WO 2005/049910 | 6/2005 |

OTHER PUBLICATIONS

European Search Report dated Oct. 11, 2017 issued in Application No. 17179067.8.

Chinese Office Action dated Jun. 28, 2019 issued in Application 201710479616.5.

*Primary Examiner* — Jason Y Ko

(74) *Attorney, Agent, or Firm* — KED & Associates LLP

(57) ABSTRACT

A noise leakage preventing device for a clothes treating apparatus is provided. The device may include a base located at a lower portion of a cabinet and forming a bottom surface of the clothes treating apparatus, and a noise blocking rim attached along a periphery of a lower surface of the base and located between the base and the ground. The noise blocking rim may prevent noise generated from the clothes treating apparatus from being transferred or emitted out the base.

17 Claims, 15 Drawing Sheets

NOISE LEAKAGE PREVENTING APPARATUS AND CLOTHES TREATING APPARATUS HAVING THE SAME

CROSS-REFERENCE TO RELATED APPLICATION

This application claims priority under 35 U.S.C. § 119 to Korean Application No. 10-2016-0085726 filed on Jul. 6, 2016, whose entire disclosure is incorporated herein by reference.

BACKGROUND

1. Field

A device that prevents noise generated during an operation of a clothes treating apparatus from being leaked through a lower portion of the clothes treating apparatus and a clothes treating apparatus having the device are provided.

2. Background

A clothes treating apparatus is an apparatus that removes contaminants from laundry. The clothes treating apparatus may perform processes, such as, e.g., washing, rinsing, removing water, and drying. Clothes treating apparatuses may be classified into a top loading type and a front loading type based on a method of loading laundry into a drum. A front loading type washing machine may be called a drum type washing machine.

The clothes treating apparatus may include a cabinet forming an outer appearance, a tub accommodated in the cabinet, a drum rotatably mounted in the tub and having laundry introduced therein, a lifter located on an inner circumferential surface of the drum to help wash the laundry by lifting and dropping the laundry, and a detergent supply device to supply detergent into the drum.

Once the laundry is placed into the clothes treating apparatus, water may be supplied to perform a washing process through rotation of the drum, followed by rinsing and removing water, and then washing water may be discharged to outside by a drain pump. During operations of the clothes treating apparatus, noise and vibrations are generated. The generated noise and vibrations may be leaked through a lower portion of the clothes treating apparatus and propagated to an installation space of the clothes treating apparatus. Legs that separate the clothes treating apparatus from the ground by a predetermined height may be provided on one side of a base of the clothes treating apparatus. Noise and vibrations generated in the clothes treating apparatus may be propagated to the outside through a space between the legs and a lower surface of the base.

The noise and vibrations coming from the lower portion of the clothes treating apparatus may be uncomfortable for users, and users may place the clothes treating apparatus in a separate closed space. This may limit space usage or where the clothes treating apparatus may be placed.

BRIEF DESCRIPTION OF THE DRAWINGS

The embodiments will be described in detail with reference to the following drawings in which like reference numerals refer to like elements wherein.

DETAILED DESCRIPTION

Figure 1:
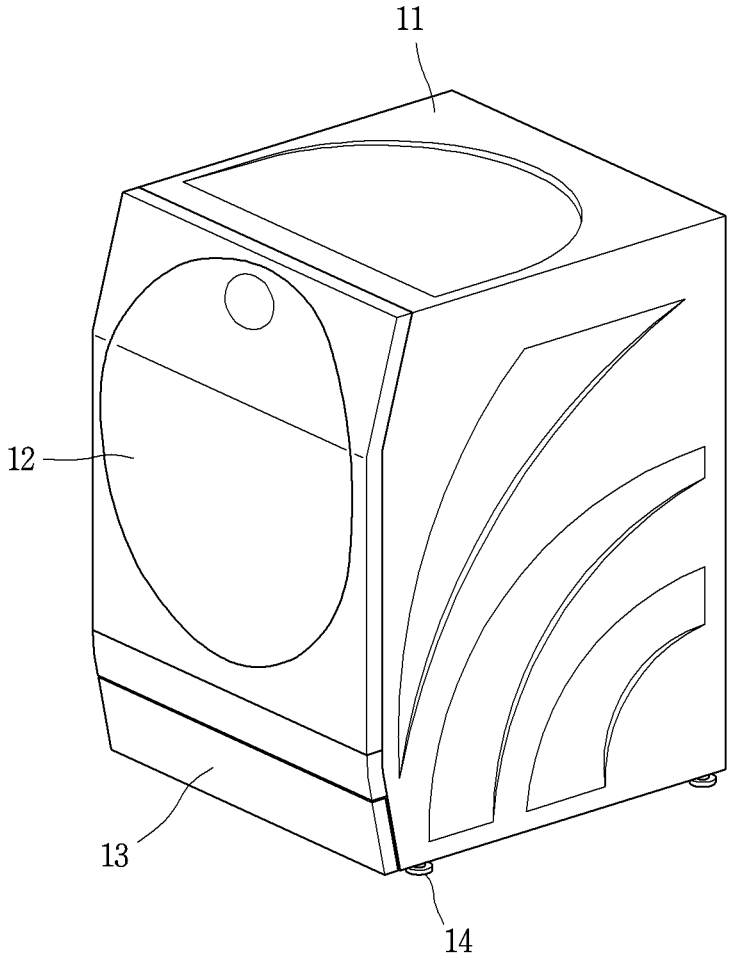
FIG. 1 is a perspective view of an outer appearance of a clothes treating apparatus.
Figure 2:
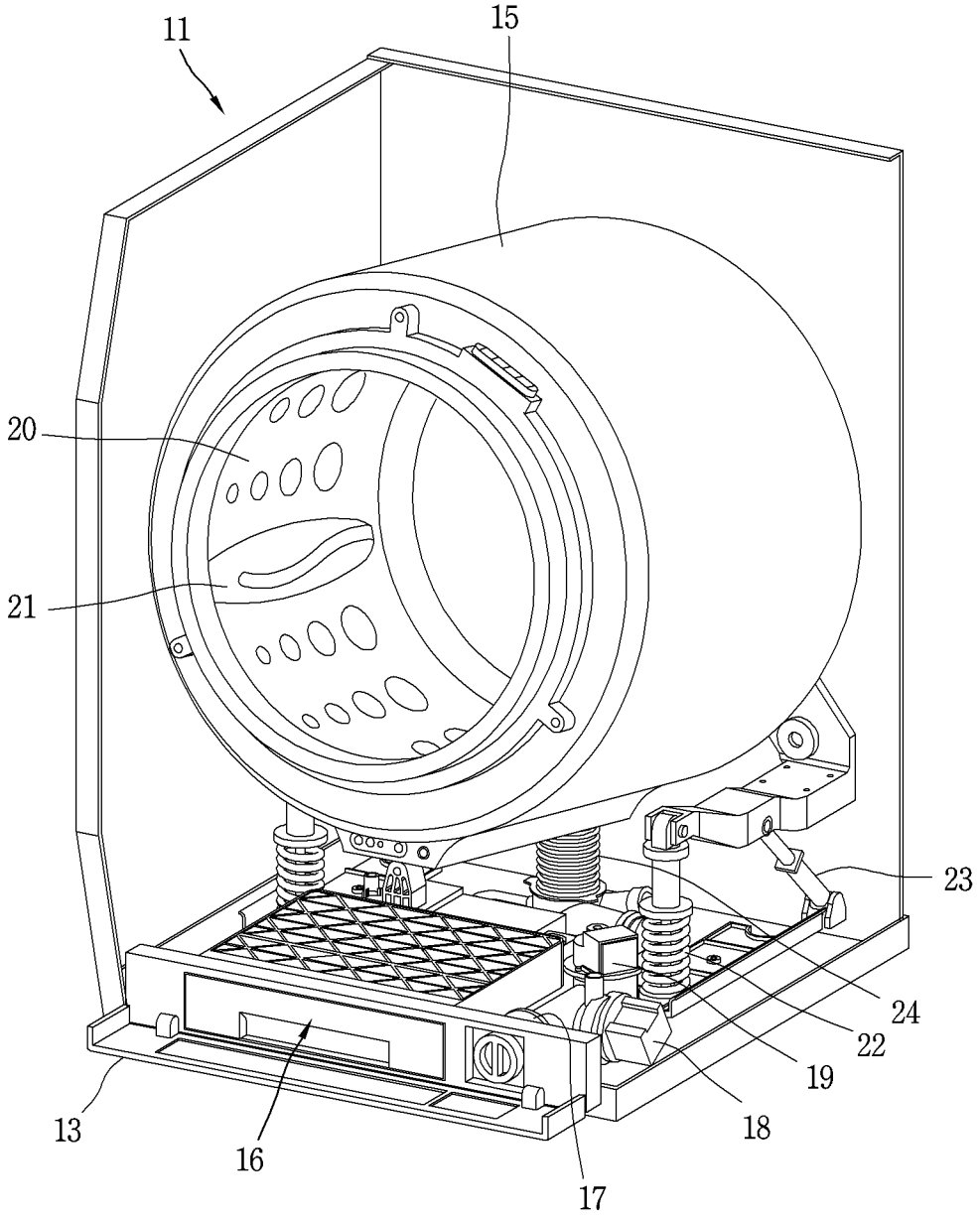
FIG. 2 is a perspective view of an inner structure of the clothes treating apparatus of FIG. 1.

Referring to FIG. 1 and FIG. 2, a clothes treating apparatus may include a cabinet 11 defining an outer appearance, a drum 20 rotatably mounted in the cabinet 11 and accommodating laundry therein, a lifter 21 installed inside the drum 20, and a door 12 installed on a front surface of the cabinet 11. An opening cover 13 that covers a detergent introduction opening for detergent may be provided at a lower portion of the cabinet 11. Depending on the type, the clothes treating apparatus may further include a duct, a heat exchanger, and the like for air circulation to dry the laundry accommodated in the drum 20.

The clothes treating apparatus may include, in the lower portion thereof, a storage container 16 in which liquid detergent or liquid softener may be stored and which may be drawn out of the cabinet 11, a plurality of elastic members 22 and/or dampers 23 that support the drum 20 to suppress vibration, and a driving motor to rotate the drum 20. The door 12 through which laundry to be washed may be taken in and out may be provided on a front surface of the cabinet 11. The door 12 may be configured to open and close a front surface of the drum 20. The door 12 may have a disk shape. An electric heater that heats water when power is applied may be provided below the drum 20.

A drain pump 18 to drain water stored in the drum 20 may be provided below the drum 20. A circulation pump 19, by which the water in the drum 20 may be pumped up to be introduced into an upper area of the drum 20, may be provided below the drum 20. A filter 17 that filters foreign materials contained in the water discharged out of the drum 20 may be provided at one side of the drain pump 18.

A base 110 (see FIG. 4) may be positioned at a lower portion of the clothes treating apparatus. The filter 17, the drain pump 18, the circulation pump 19, the elastic members 22, and the like may be provided on an upper portion of the base 110. The base 110 may form a bottom surface of the clothes treating apparatus.

The base 110 may be provided with a plurality of legs 14 by which the clothes treating apparatus may be spaced apart from the ground by a predetermined height. The legs 14 may support the clothes treating apparatus. Noise and vibration generated during an operation of the clothes treating apparatus may be transferred out through a space between the legs 14 and a lower surface of the base 110 via the lower base 110.

Figure 3:
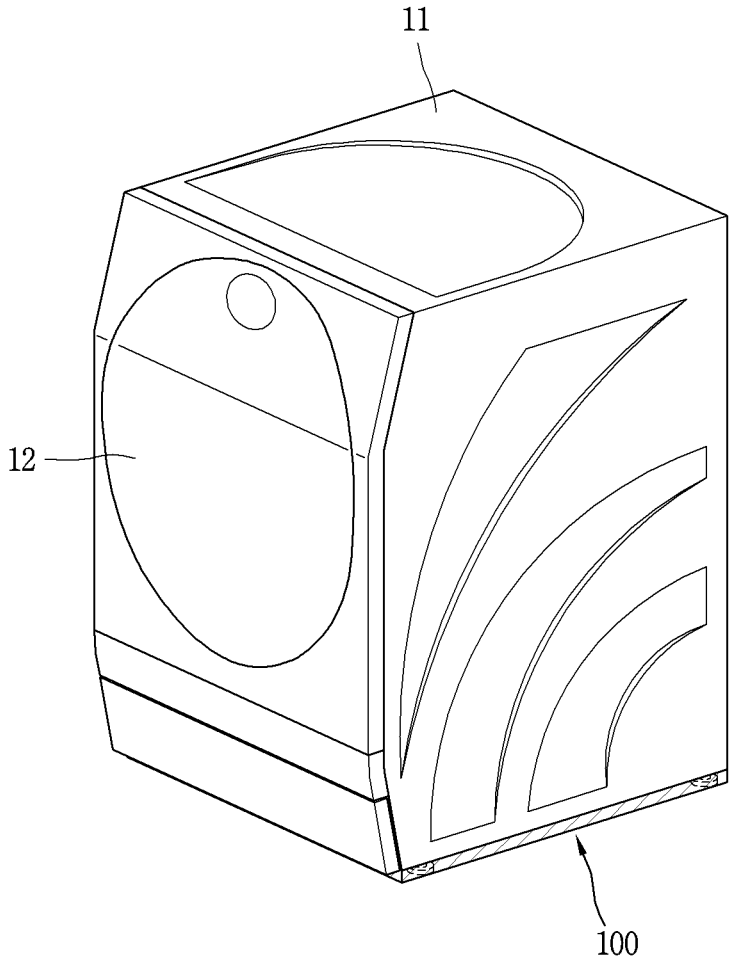
FIG. 3 is a perspective view of a clothes treating apparatus including a noise leakage preventing device.

Noise and vibrations, which may be generated within the clothes treating apparatus during an operation of the clothes treating apparatus, may be leaked through or come out from the lower base 110. Referring to FIG. 3, a noise leakage preventing device 100 may hermetically seal the space between the ground and the legs 14 to prevent noise from being leaked to or heard from the outside. The noise leakage preventing device 100 of the clothes treating apparatus may be configured such that a noise blocking member (e.g., a rib, rim, or frame) 120 and/or a noise blocking panel or plate 130 are coupled to the base 110.

Figure 4:
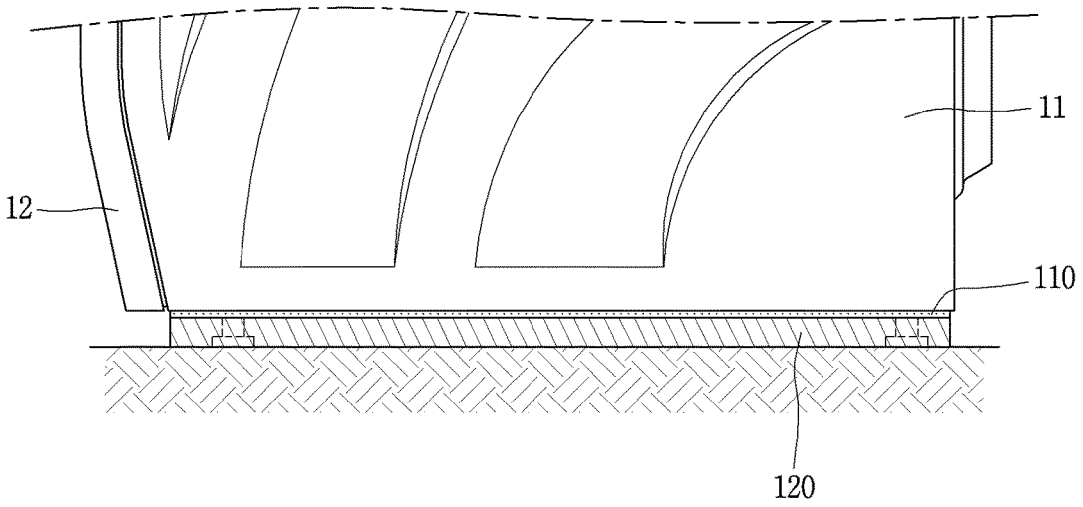
FIG. 4 is a lateral view of a noise blocking member coupled to a clothes treating apparatus.

Referring to FIG. 4, the noise leakage preventing apparatus 100 may be constructed such that the noise blocking member 120 is coupled along a lower periphery of the base 110. The base 110 may be attached to a lower portion of the cabinet 11 to form a bottom surface of the clothes treating apparatus. The components constituting the clothes treating apparatus may be coupled to an upper surface of the base 110.

The base 110 may be made of a metallic material. A plurality of through holes through which noise may be emitted or discharged or a plurality of coupling holes through which screws may be inserted may be formed through the surface of the base 110. Accordingly, noise generated within the clothes treating apparatus may be leaked or emitted externally through the through holes or the coupling holes.

Accordingly, the generated noise and vibrations may partially be absorbed by coupling the noise blocking member 120 along a periphery of the lower surface of the base 110, and the space between the lower surface of the base 110 and the legs 14 may be hermetically sealed. Since the clothes treating apparatus may be formed in a rectangular shape, the base 110 may also be formed in a rectangular shape.

A flat portion on which the noise blocking member 120 may be located may be provided along the periphery of the lower surface of the base 110, so as to facilitate the noise blocking member 120 to be coupled along the periphery of the lower surface of the base 110. The noise blocking member 120 may be attached along the periphery of the lower surface of the base 110, and may extend in one direction. The noise blocking member 120 may be located between the base 110 and the ground so as to be compressed by a load of the clothes treating apparatus applied toward the ground.

The clothes treating apparatus may be spaced apart from the ground by the legs 14 at a predetermined height. Since the noise blocking member 120 may be attached along the periphery of the lower surface of the base 110 to be located between the base 110 and the ground, noise and vibrations generated during operation of the clothes treating apparatus may be prevented from being leaked or emitted through the lower surface of the base 110.

Figure 5:
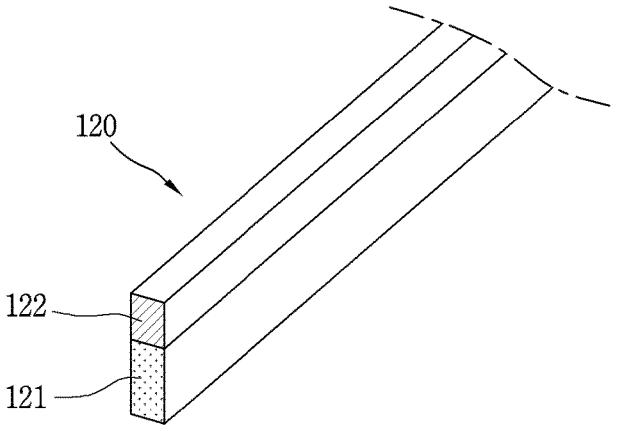
FIG. 5 is a perspective view of an outer appearance and an inner structure of a noise blocking member.

Referring to FIG. 5, the noise blocking member 120 may extend in one direction and may be compressed by the load of the clothes treating apparatus. Therefore, the noise blocking member 120 may have a height greater than a distance between the base 110 and the ground. The noise blocking member 120 may be formed of two different materials.

The noise blocking member 120 may be made of synthetic resin to have predetermined elasticity and sound absorption and insulation properties, but may be made of rubber or sponge. The noise blocking member may be formed in such a manner that a first member 121 made of a soft material and a second member 122 made of a harder material than the first member 121 are stacked with each other.

The first member 121 may be made of a material which is compressible. The first member 121 may be compressed by the load of the clothes treating apparatus between the lower portion of the clothes treating apparatus and the ground. Density of the first member 121 may be increased when the first member 121 is compressed by the load. This may result in effectively preventing the noise generated in the clothes treating apparatus from being leaked or emitted out.

The second member 122 may be made of a material different from that of the first member 121. The second member 122 may be made of a material which is hard in order to shield noise and has high density to effectively prevent the noise leakage.

Referring to FIG. 5, the noise blocking member 120 may be configured such that the first member 121 may be provided on top of the second member 122 or vice versa. The first member 121 and the second member 122 may be formed to have different thicknesses from each other. Since the first member 121 may be made of a material that is compressible, the first member 121 may preferably be thicker or taller than the second member 122.

The noise blocking member 120 may have a thickness or a height greater than a spaced height between the clothes treating apparatus and the ground. Therefore, the sum of thicknesses of the first member 121 and the second member 122 may be greater than a spaced distance between the base 110 of the clothes treating apparatus and the ground.

Figure 6:
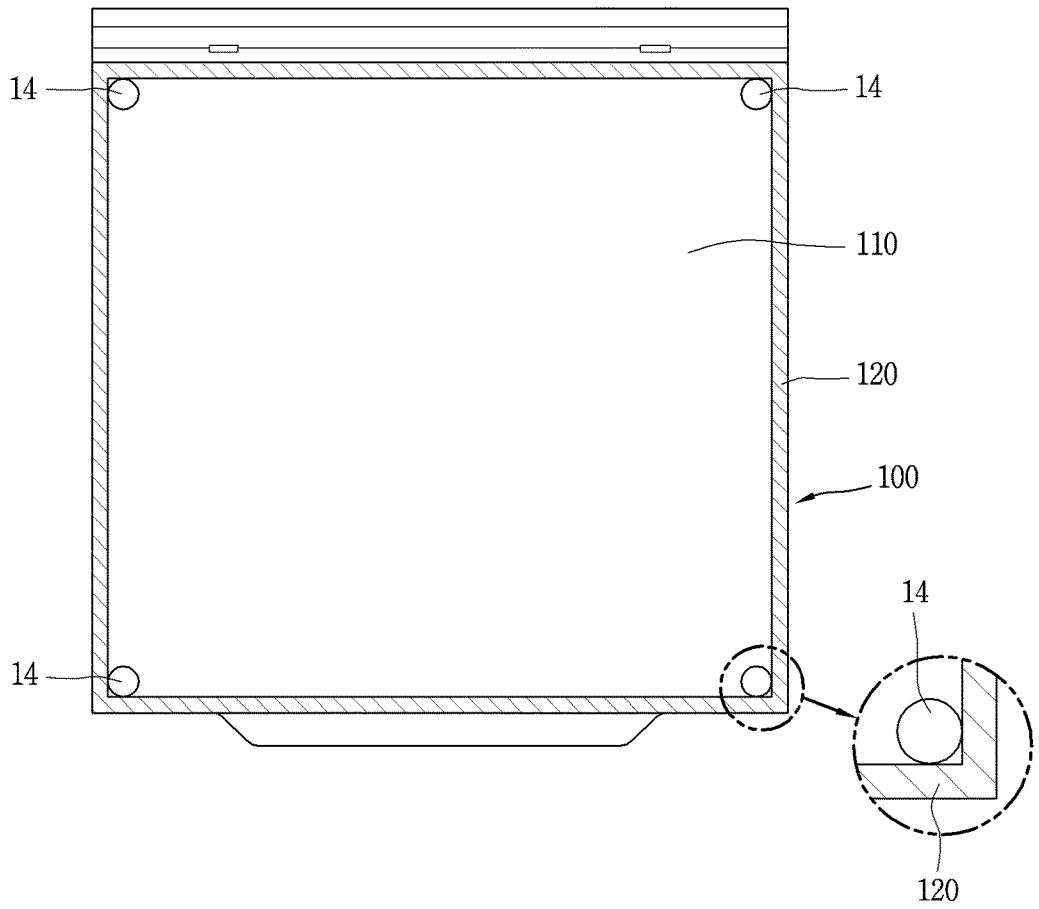
FIG. 6 is a bottom view of a clothes treating apparatus including a noise blocking member.

FIG. 6 illustrates an embodiment of a noise leakage preventing device 100 with the noise blocking member 120 installed thereon. The legs 14 may each have a rounded shape. The legs 14 to support the clothes treating apparatus may be symmetrically located at four corners of the base 110. The noise blocking member 120, as illustrated in FIG. 6, may be attached along the periphery of the base 110 at the outside of the legs 14.

The noise blocking member 120 may be attached along the periphery of the rectangular base 110 and thus may not surround the legs 14. The noise blocking member 120, as illustrated in FIG. 6, may be integrally formed so as to block noise leaked to the outside through the lower portion of the base 110. The structure of the noise blocking member 120 may be the same as that illustrated in FIG. 5.

Figure 7:
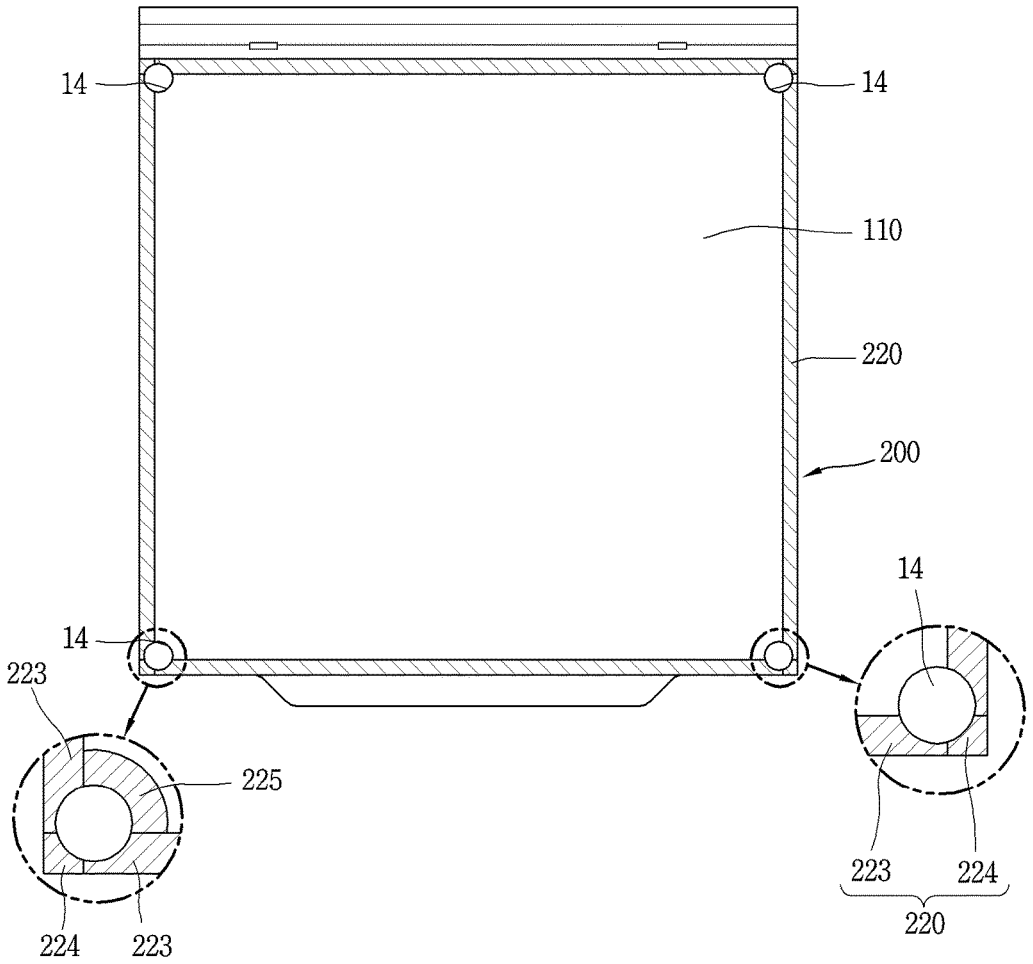
FIG. 7 is a bottom view of a clothes treating apparatus including a noise blocking member having a different shape from that of FIG. 6.

FIG. 7 illustrates another embodiment of a noise leakage preventing device 200 in which a noise blocking member 220 having a shape different from that of FIG. 6 may be provided. The noise blocking member 220 may be attached along the periphery of the base 110 and located at edges of the base 110. The noise blocking member 220 may be located outside the legs 14. Thus, the noise blocking member 220 may further include corner portions formed to surround circumferences of the legs 14, so as to minimize gaps between the legs 14 and the noise blocking member.

As illustrated in FIG. 7, the noise blocking member 220 may include linear members 223 each extending along one direction and attached to each edge of the base 110, and inner corner members 225 each having a curved inner surface for surrounding the legs 14 and attached to each vertex portion of the base 110.

The linear members 223 may be located along the periphery of the base 110 to prevent noise from being leaked out from the lower portion of the base 110. The corner members 224 may surround an outside of the legs 14 so as to block gaps between the linear members 223 and the legs 14, thereby more effectively preventing the noise leakage to the outside through the lower portion of the base 110. The noise blocking member 220, as illustrated in a lower left drawing of FIG. 7, may further include inner corner members 225 surrounding the legs 14 at the inside of the legs, respectively. The structure of the noise blocking member 220 may be the same as that of FIG. 5.

Figure 8:
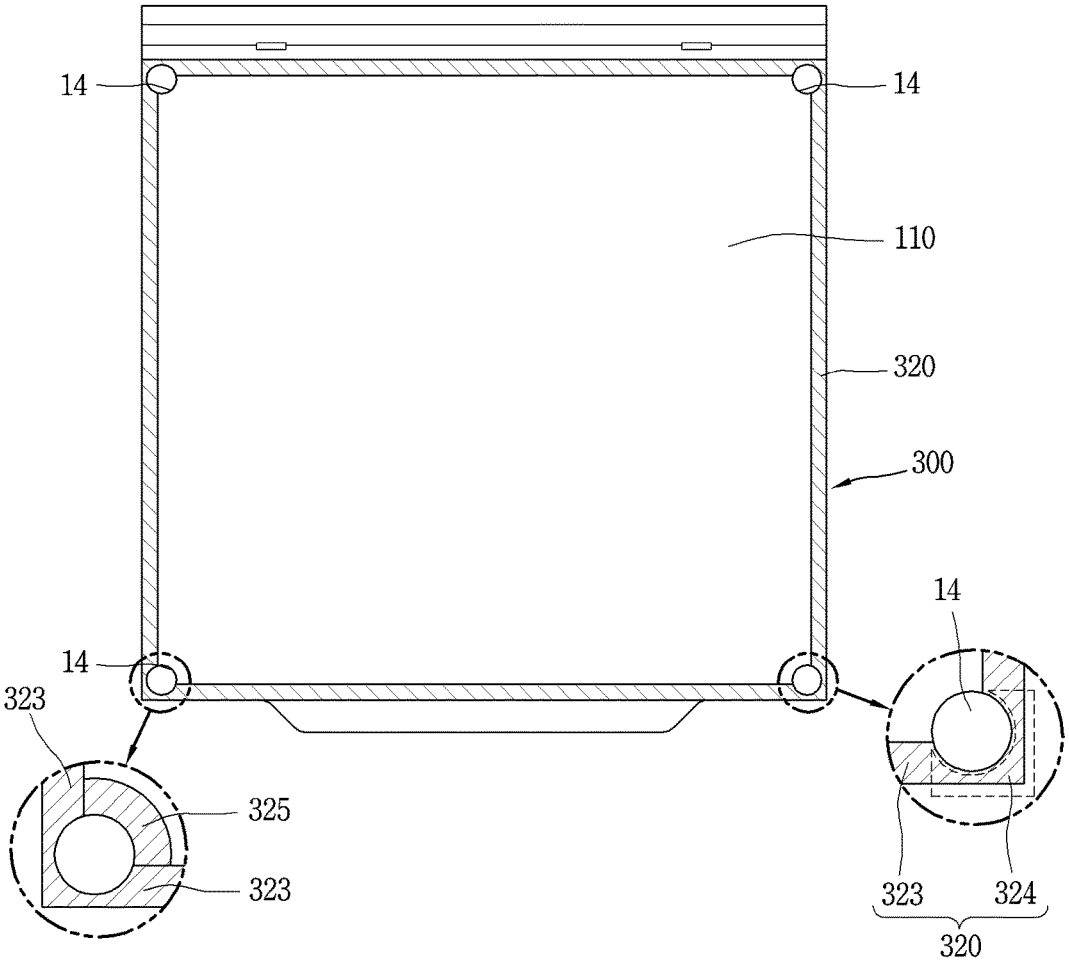
FIG. 8 is a bottom view of another embodiment of a clothes treating apparatus including a noise blocking member.

FIG. 8 illustrates another embodiment of a noise leakage preventing device 300 in which a noise blocking member 320 may include linear portions 323 attached along the periphery of the base 110, and bent portions 324 surrounding an outside of the legs 14. The linear portions 323 and the bent portions 324 may be integrally formed. As the noise blocking member 320 is constituted by the linear portions 323 and the bent portions 324 integrally formed with each other, noise leaked or emitted through surrounding areas of the legs 14 may be more effectively prevented. The noise blocking member 320, as illustrated in a lower left drawing of FIG. 8, may further include second bent portions 325 surrounding an inside of the legs 14, respectively, thereby preventing leakage of the noise more effectively. The structure of the noise blocking member 320 may be the same as that of FIG. 5.

As can be appreciated, various configurations are possible. For example, the noise blocking member 120 may be installed a predetermined distance from the periphery of the base 110 on all four sides or on two sides whereas another two sides are provided on the periphery.

Figure 9:
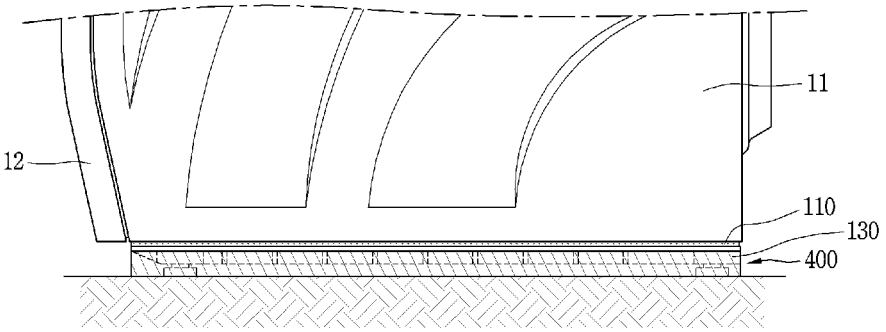
FIG. 9 is a lateral view of a clothes treating apparatus including a noise blocking member and a noise blocking panel.

FIG. 9 illustrates a clothes treating apparatus in which a noise leakage preventing device 400 provided with the noise blocking member 120, 220, 320 and a noise blocking panel 130 may be installed. The noise leakage preventing device 400 may include the noise blocking member 120, 220, 320 and a noise blocking panel 130. A noise blocking member 120, 220, 320 may be attached along the periphery of the lower surface of the base 110, and the noise blocking panel 130 may be attached to the lower surface of the base 110 at an inside of the noise blocking member 120, 220, 320.

As illustrated in FIG. 9, since the noise blocking member 120, 220, 320 is located between the base 110 and the ground, the noise blocking member 120, 220, 320 may have a shape blocking the lower portion of the clothes treating apparatus to prevent an external exposure of the lower portion of the clothes treating apparatus. The noise blocking panel 130 120, 220, 320 attached to the lower surface of the base 110 at the inside of the noise blocking member. The noise blocking panel 130 may be attached to the lower surface of the base 110 to prevent noise leaked from the lower portion of the base 110.

The noise blocking member, as aforementioned, may be attached along the periphery of the base 110 at the outside of the legs 14. In addition, the noise blocking member may have the structure in which two materials are stacked as illustrated in FIG. 5, and have the shape illustrated in FIG. 6 to FIG. 7.

Figure 10:
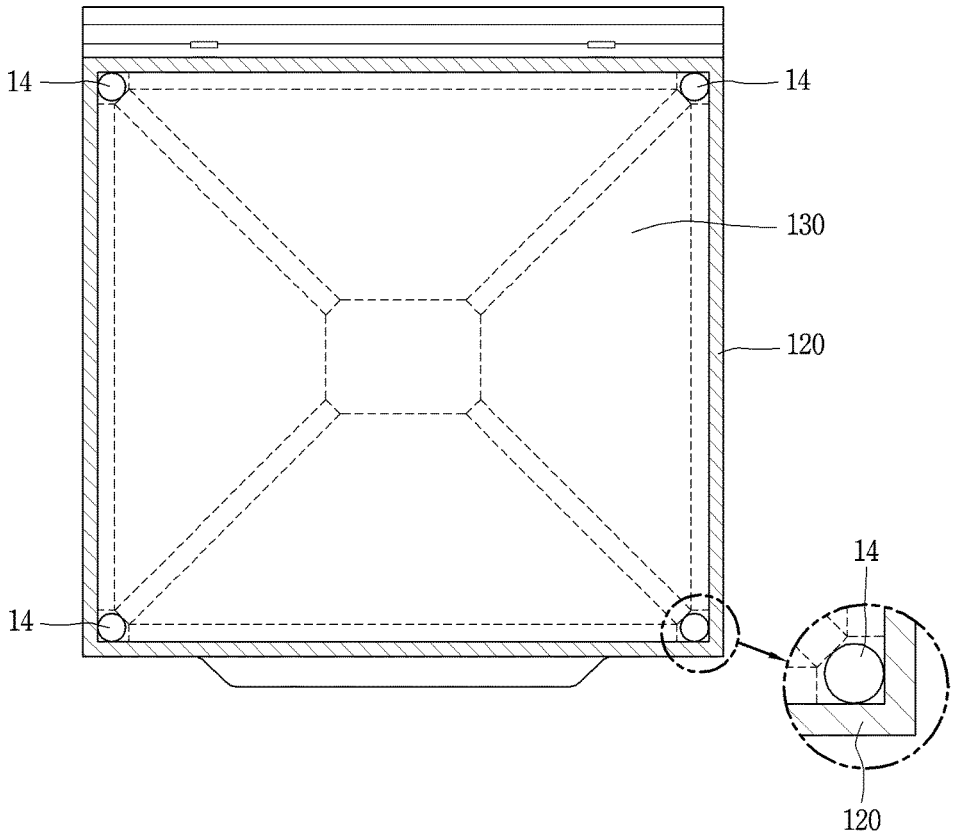
FIG. 10 is a bottom view of a noise blocking member and a noise blocking panel coupled to a bottom surface of a base.
Figure 11:
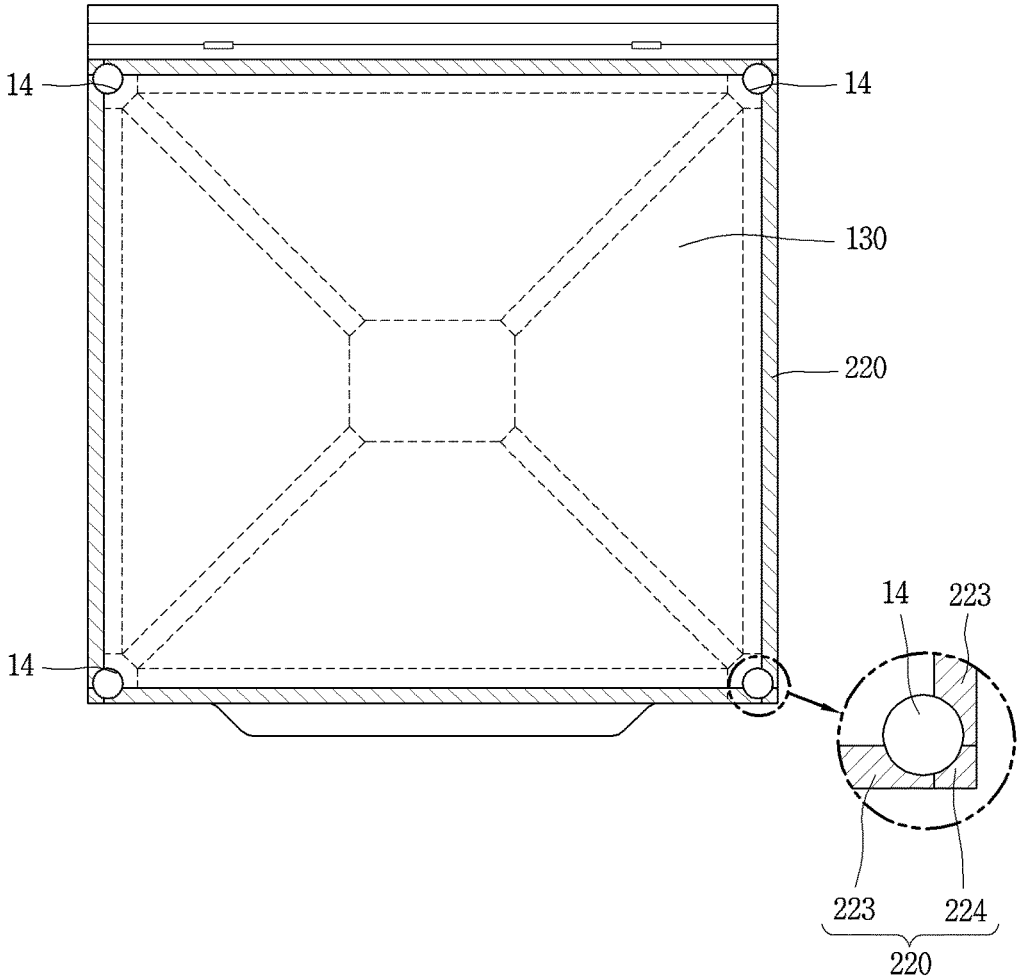
FIG. 11 is a view of another embodiment of a noise blocking member and a noise blocking panel coupled to a bottom surface of a base.
Figure 12:
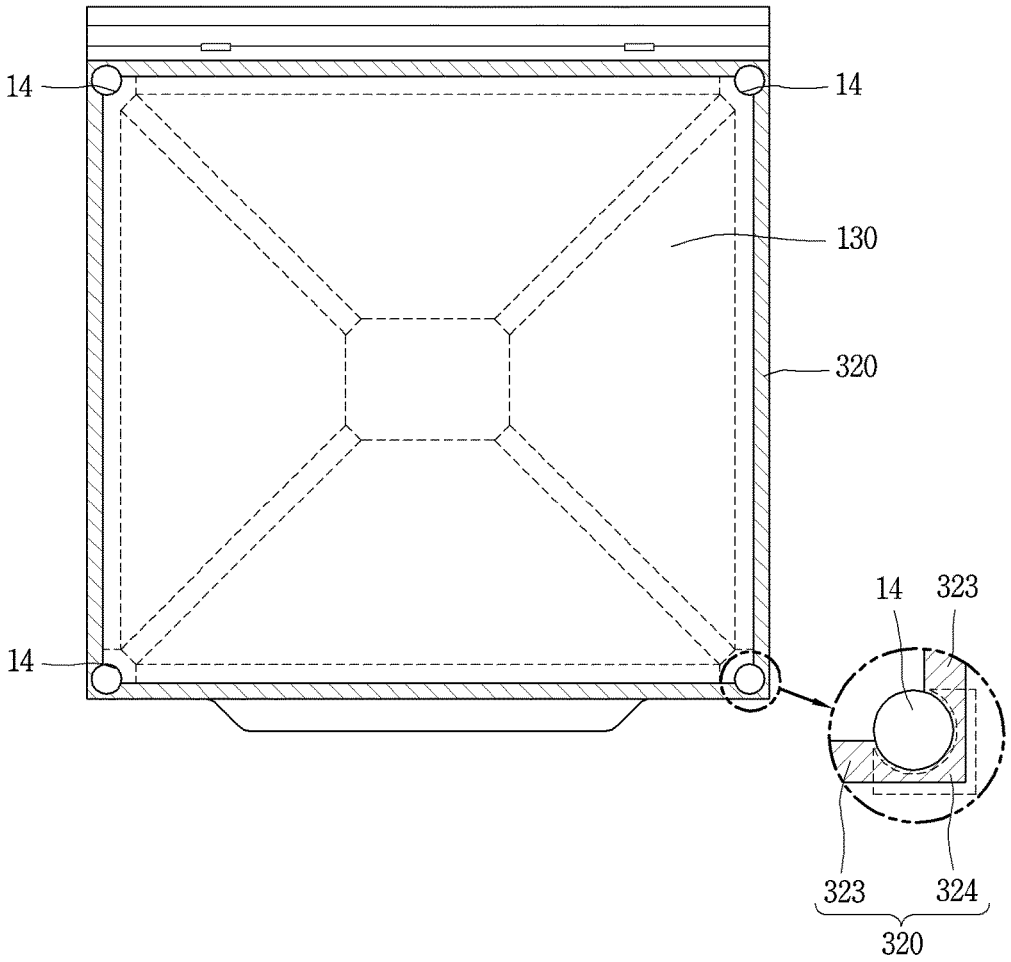
FIG. 12 is a view of another embodiment of a noise blocking member and a noise blocking panel coupled to a bottom surface of a base.

FIG. 10 to FIG. 12 illustrate a noise leakage preventing device provided with the noise blocking member 120, 220, and 320, respectively, and the noise blocking panel 130. As described above, the noise blocking member and the noise blocking panel 130 may absorb a part of the noise generated in the clothes treating apparatus and leaked or emitted from the lower portion of the clothes treating apparatus, and prevent external leakage or emittance of the noise.

FIG. 10 illustrates the noise blocking member 120 having the shape as illustrated in FIG. 6 and the noise blocking panel 130 coupled to the lower surface of the base 110. FIG. 11 illustrates the noise blocking member 220 having the shape as illustrated in FIG. 7 and the noise blocking panel 130 attached to the lower surface of the base 110. FIG. 12 illustrates the noise blocking member 320 having the shape as illustrated in FIG. 8 and the noise blocking panel 130 attached to the lower surface of the base 110. The description of the noise blocking member 120, 220, 320 may be the same as the foregoing description.

Figure 13:
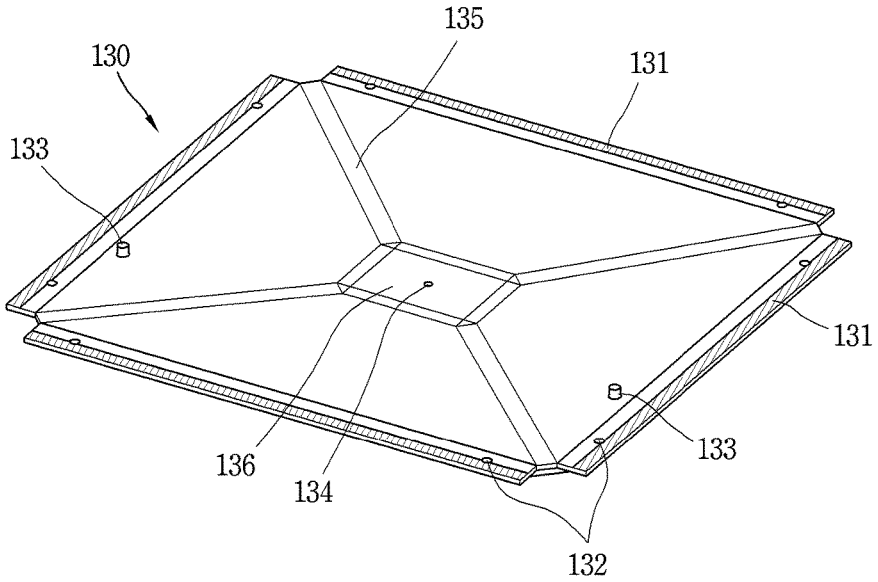
FIG. 13 is a perspective view of a noise blocking panel.
Figure 14:
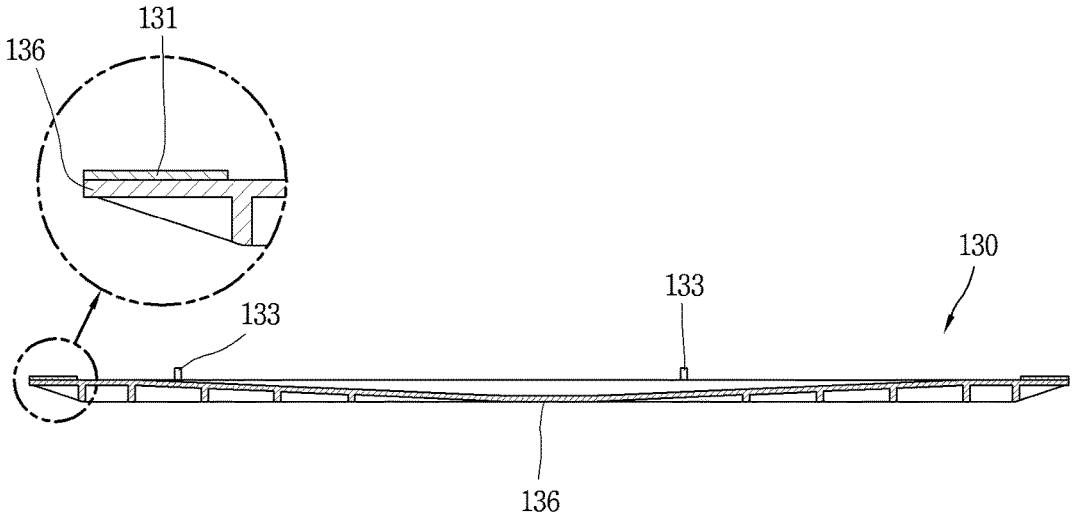
FIG. 14 is a lateral view of a noise blocking panel.
Figure 15A:
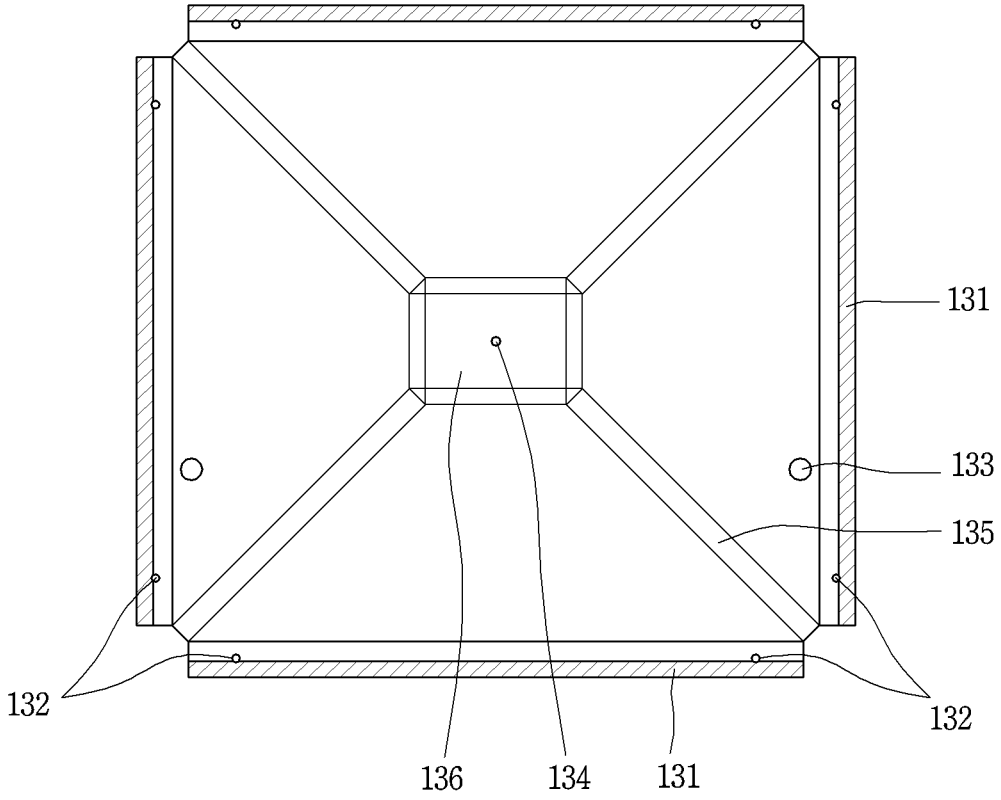
FIG. 15A is a planar view of an upper surface of a noise blocking panel.
Figure 15B:
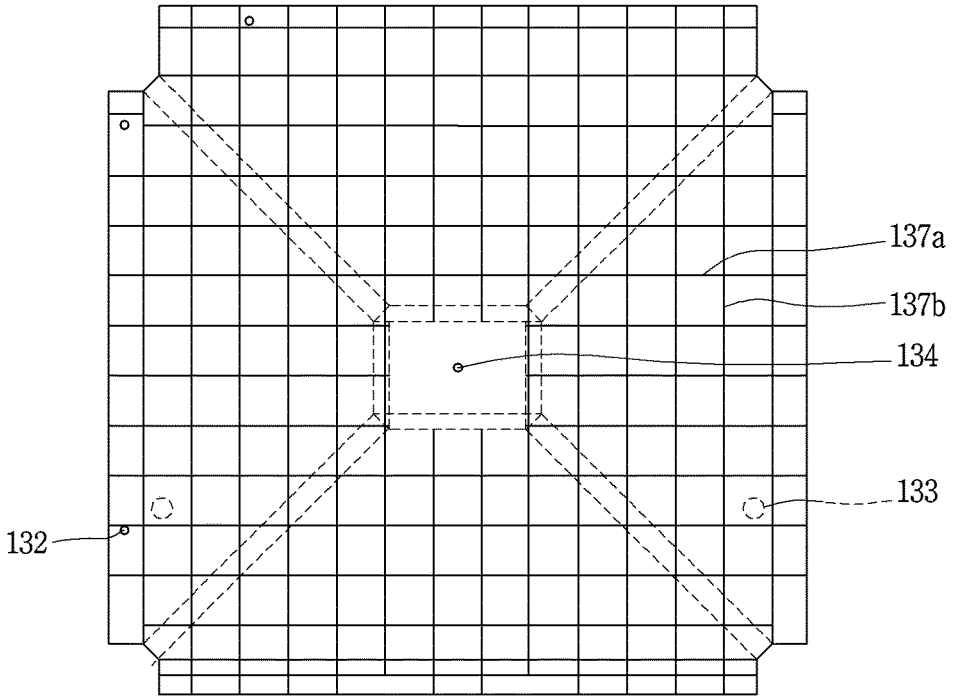
FIG. 15B is a bottom view of a lower portion of a noise blocking panel.

FIG. 13 is a perspective view illustrating the noise blocking panel 130, FIG. 14 is a lateral view of the noise blocking panel 130, and FIG. 15A and FIG. 15B are a planar view and a bottom view of the noise blocking panel 130, viewed from the top. The noise blocking panel 130 may be formed in a shape of a rectangular plate and each vertex portion thereof may be bent toward a central portion thereof so as to surround the inner surfaces of the legs 14 located on the base 110.

A drain hole 134 for drainage may be formed through an upper surface of the noise blocking panel 130, where the upper surface may be a surface attached to the lower surface of the base 110. The drain hole 134 may be through the central portion of the upper surface of the noise blocking panel 130, such that a liquid may be externally discharged without being collected at the central portion of the upper surface of the noise blocking panel 130 when the liquid is discharged from the lower portion of the base 110.

Grooves 135 along which the liquid discharged from the base 110 may flow toward the drain hole 134 may be formed on the upper surface of the noise blocking panel 130 toward the drain hole 134. The grooves 135 may form a drain portion 136 with a height lower than surrounding portions thereof, such that the liquid may be collected toward the drain hole 134 along the grooves 135.

Screw portions 132 (e.g., holes or recesses) may be formed through portions adjacent to each vertex of the noise blocking panel 130 in a spaced manner, such that the noise blocking plate 130 may be attached to the lower surface of the base 110 using screws. The screw portions 132 may be located at a plurality of points along the surface of the noise blocking panel 130.

Attachment pads 131 that may be closely attached to the lower surface of the base 110 may be provided on each edge of the noise blocking panel 130. Each of the attachment pads 131 may be attached to the lower surface of the base 110 made of metal using an adhesive, thereby preventing the noise generated during the operation of the clothes treating apparatus from be leaked to the outside through the edges and simultaneously preventing the noise blocking panel 130 from being separated from the base 110 due to vibrations. The attachment pad 131 may be formed along an outer side of each edge.

Guide pins 133 may be formed on the upper surface of the noise blocking panel 130 so that the noise blocking panel 130 may be better attached or aligned to the lower surface of the base 110. The guide pins 133 may be inserted into guide pin accommodating portions such as, e.g., holes or recesses, formed on the base 110. Each of the guide pins 133 may have a shape that protrudes from the upper surface of the noise blocking panel 130. The guide pin 133 may be provided in plurality on one side of the upper surface of the noise blocking panel 130.

The noise blocking panel 130 may be provided with a plurality of ribs 137*a* extending along one direction in parallel for reinforcing rigidity of the noise blocking panel 130. The ribs 137*a* may be located inside the noise blocking panel 130 to increase rigidity of the noise blocking panel 130. The ribs 137*a* may be made of a material different from that of the noise blocking panel 130 and may prevent the noise blocking panel 130 from being damaged due to vibration generated during the operation of the clothes treating apparatus.

FIG. 15B illustrates the ribs 137*a* exposed from a lower surface of the noise blocking panel 130. The plurality of ribs 137*a* may be arranged inside the noise blocking panel 130 to be in parallel at predetermined intervals. Another plurality of ribs 137*b*, which may be arranged in an intersecting direction with the plurality of ribs 137*a*, may also be arranged to be in parallel at predetermined intervals.

The noise blocking panel 130 may be made of a plastic material, such as, e.g., polypropylene. By using the plastic material, the noise blocking panel 130 may absorb the noise and vibrations generated within the clothes treating apparatus, thereby reducing the noise and vibrations heard or emitted. Other materials exhibiting noise and/or vibration reduction may be used.

Figure 16:
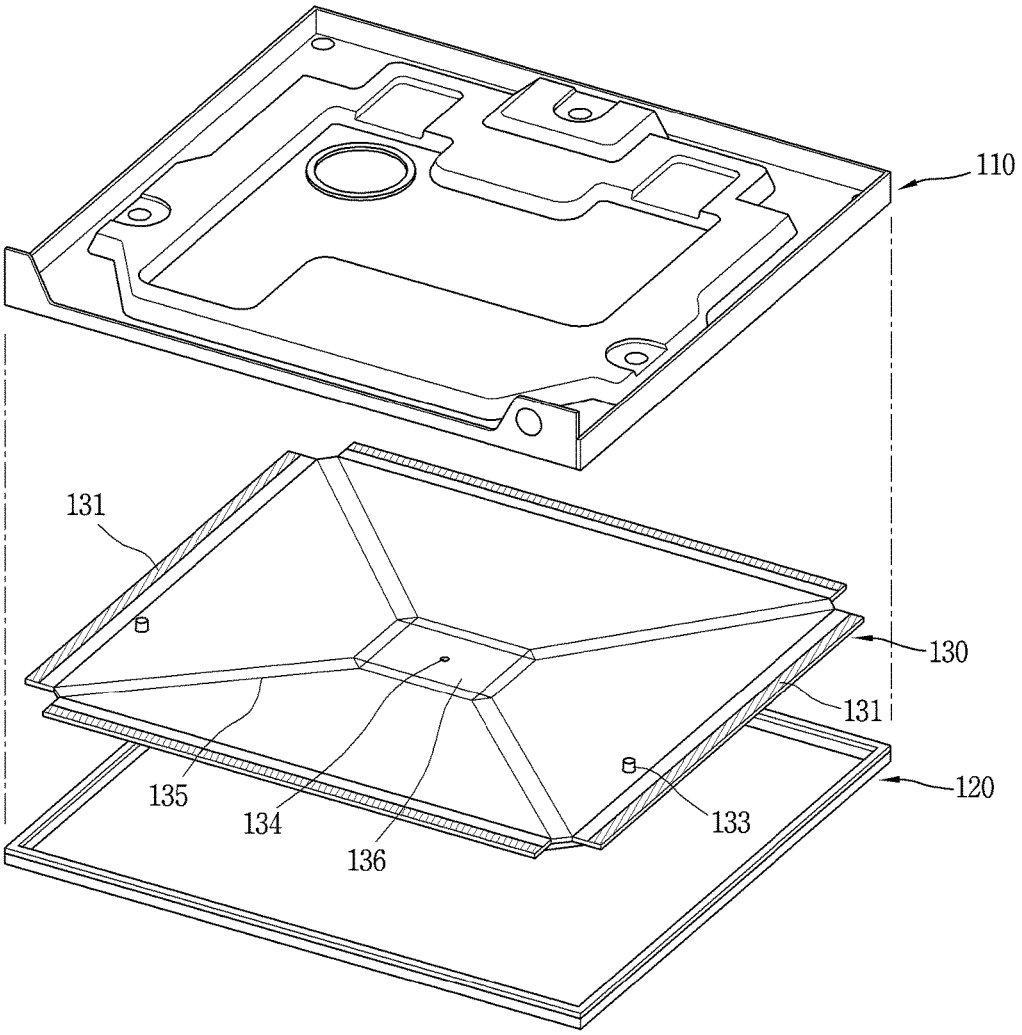
FIG. 16 is a conceptual view of a noise leakage preventing device coupled to a base.

Referring to FIG. 16, the base 110 forms the bottom surface of the clothes treating apparatus, and may be provided with the noise blocking member coupled thereto along the periphery of the base 110. The noise blocking panel 130 may be located inside the noise blocking member attached to the periphery of the lower surface of the base 110. The noise blocking member may be located on the outer side or periphery of the lower surface of the base 110, and the noise blocking panel 130 may be attached to the lower surface of the base 110 at the inside of the noise blocking plate. The noise blocking member and the noise blocking panel 130 may be arranged side by side on the basis of the lower surface of the base 110.

A clothes treating apparatus including the thusly-configured noise leakage preventing device may include a cabinet 11, a tub 15 provided within the cabinet 11, a drum 20 rotatably provided within the tub 15 and accommodating laundry or things to be dried therein, a base 110 located at a lower portion of the cabinet 11 and forming a bottom surface of the clothes treating apparatus, a noise blocking member extending in one direction and attached along a periphery of a lower surface of the base 110 to be located between the base 110 and the ground, and a noise blocking panel 130 formed in a shape of a rectangular plate and having vertex portions bent toward a central portion thereof to surround inner surfaces of legs 14. With this configuration, the clothes treating apparatus may prevent noise generated during a washing process from being externally leaked through a lower portion of the clothes treating apparatus via the base 110.

Embodiments disclosed herein may provide a device capable of preventing noise generated during operation of a clothes treating apparatus from being leaked or emitted externally through a lower portion of the clothes treating apparatus. Embodiments disclosed herein may further provide a device attached to a bottom surface of a base and capable of minimizing noise leakage through the base. Embodiments disclosed herein may also provide a device capable of reducing external noise leakage by absorbing a part of noise generated during an operation of a clothes treating apparatus and transferred through a lower portion of the clothes treating apparatus. Embodiments disclosed herein may also provide a clothes treating apparatus capable of reducing noise leakage through a lower base.

According to embodiments disclosed herein, a noise leakage preventing device for a clothes treating apparatus may include a base located at a lower portion of a cabinet and forming a bottom surface of the clothes treating apparatus, and a noise blocking member extending in one direction, and attached along a periphery of a lower surface of the base to be located between the base and the ground, the noise blocking member preventing noise generated during a washing or dewatering process from being transferred to outside via the base.

The noise blocking member may be compressed by a load of the cabinet applied toward the ground. The noise blocking member may have a thickness greater than a distance between the base and the ground. The noise blocking member may surround legs at an outside or inside of the legs, the legs fixed to the base to support the cabinet.

The noise blocking member may be formed by stacking two different materials. The noise blocking member may include a first member made of a material compressed by a load, and a second member attached to the first member, and made of a material having density greater than that of the first member to prevent an external leakage of the noise. The first member and the second member may have different thicknesses from each other.

The device may further include a noise blocking plate formed in a shape of a rectangular plate and having vertex portions bent toward a central portion thereof to surround inner surfaces of legs, respectively, the legs fixed to the base to support the cabinet. The noise blocking plate may be provided with guide pins protruding from an upper surface thereof toward the base to be inserted into guide pin accommodating portions, such that the noise blocking plate is coupled to the base. The noise blocking plate may be provided with attachment pads provided on edges thereof, respectively, and having adhesive strength such that the noise blocking plate is attached to the base.

The noise blocking plate may be provided with screw coupling portions formed on a plurality of points, such that the noise blocking plate is fixed to the base by screws. The noise blocking plate may be provided with a drain hole formed through a central portion thereof, so that a liquid discharged through the base flows externally.

The noise blocking plate may be provided with grooves formed on an upper surface thereof and extending toward a drain hole, so that a liquid discharged through the base flows toward the drain hole. The noise blocking plate is provided at an inside thereof with a plurality of ribs extending in parallel along one direction for reinforcing rigidity of the noise blocking plate.

According to embodiments disclosed herein, a clothes treating apparatus may include a cabinet, a tub provided within the cabinet, a drum rotatably provided within the rub to accommodate laundry or things to be dried therein, a base located at a lower portion of the cabinet and forming a bottom surface of the clothes treating apparatus, a noise blocking member extending in one direction and attached to a periphery of a lower surface of the base to be located between the base and the ground, and a noise blocking plate formed in a shape of a rectangular plate and having vertex portions bent toward a central portion thereof to surround inner surfaces of legs, respectively, the legs fixed to the base to support the cabinet, wherein noise generated during a washing process is prevented from being leaked to outside through the base.

According to the embodiments disclosed herein, a space formed between the lower surface of the base and the ground may be blocked, thereby preventing external leakage of the noise generated in the clothes treating apparatus. The noise blocking member located along the periphery of the lower surface of the base may hermetically seal the space between the base and the legs, thereby reducing noise leaked through the base. The noise blocking panel, which may be made of a material capable of absorbing noise, may be attached on the base so as to absorb a part of the noise generated in the clothes treating apparatus, thereby reducing external leakage of the noise.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A noise leakage preventing device for a clothes treating apparatus, the device comprising:

a base located at a lower portion of a cabinet of the clothes treating apparatus so as to form a bottom surface of the clothes treating apparatus;

a noise blocking rim attached along a periphery of a lower surface of the base and provided between the base and a ground so as to prevent noise generated from the clothes treating apparatus from being emitted out through the base; and a noise blocking panel formed in a rectangular plate shape and having vertex portions bent toward a central portion of the noise blocking panel, the noise blocking panel configured to surround inner surfaces of a plurality of legs fixed to the base to support the cabinet.

2. The device of claim 1, wherein the noise blocking rim is compressed by a load of the cabinet applied toward the ground.

3. The device of claim 1, wherein the noise blocking rim has a height greater than a distance between the base and the ground.

4. The device of claim 1, wherein the noise blocking rim surrounds a plurality of legs at an outside or inside of each of the plurality of legs, the plurality of legs being fixed to the base to support the cabinet.

5. The device of claim 1, wherein the noise blocking rim is formed by stacking two layers of different materials.

6. The device of claim 1, wherein the noise blocking rim includes:

a first layer made of a compressible material; and a second layer attached to the first layer and made of a material having density greater than a density of the first layer.

7. The device of claim 6, wherein the first layer and the second layer have different heights from each other.

8. The device of claim 1, wherein the noise blocking panel is provided with a plurality of guide pins that protrude from an upper surface thereof toward the base to be inserted into a plurality of guide pin recesses, respectively, such that the noise blocking panel is coupled to the base.

9. The device of claim 1, wherein an attachment pad is provided on each edge of the noise blocking panel, the attachment pad configured to adhere the noise blocking panel to the base.

10. The device of claim 1, wherein the noise blocking panel is provided with screw recesses formed on a plurality of points so that the noise blocking panel is fixed to the base by screws.

11. The device of claim 1, wherein the noise blocking panel includes a drain hole formed through a central portion of the noise blocking panel so that liquid discharged through the base flows out through the drain hole.

12. The device of claim 1, wherein the noise blocking panel includes a plurality of grooves formed on an upper surface thereof and extending toward a drain hole so that liquid discharged through the base flows toward the drain hole.

13. The device of claim 1, wherein the noise blocking panel is provided at an inside thereof with a plurality of ribs that extend in parallel along one direction to reinforce rigidity of the noise blocking panel.

14. A clothes treating apparatus, comprising:

a cabinet;

a tub provided within the cabinet;

a drum rotatably provided within the tub to accommodate laundry;

a base located at a lower portion of the cabinet and forming a bottom surface of the clothes treating apparatus;

a noise blocking rim attached to a periphery of a lower surface of the base and provided between the base and the ground; and a noise blocking panel formed in a rectangular shape having vertex portions recessed to be disposed around outer surfaces of a plurality of legs when the base and the noise blocking panel are combined with the clothes treating apparatus having the plurality of legs fixed to the base to support the cabinet, wherein noise generated by the clothes treating apparatus is prevented from being emitted out through the base.

15. The clothes treating apparatus of claim 14, wherein the noise blocking panel is provided at an inside thereof with a plurality of first ribs that extend in parallel along one direction and a plurality of second ribs that extend in parallel along another direction to reinforce rigidity of the noise blocking panel.

16. The clothes treating apparatus of claim 14, wherein the noise blocking rim includes linear portions attached along the periphery of the base, and bent portions surrounding an outside of each of the plurality of legs, wherein the linear portions and the bent portions are integrally formed.

17. The clothes treating apparatus of claim 14, wherein the noise blocking rim includes linear members attached to each edge of the base and inner corner members each having a curved inner surface and attached to each vertex portion of the base to surround an inner surface of each of the plurality of legs.

* * * * *